US006122898A

United States Patent [19]

De Kort

[11] Patent Number: 6,122,898

[45] Date of Patent: Sep. 26, 2000

[54] PACKAGING MACHINE

[75] Inventor: Matheus Wilhelmus Johannes De Kort, Breda, Netherlands

[73] Assignee: Klockner Hansel Tevopharm B.V., Schiedam, Netherlands

[21] Appl. No.: 09/134,670

[22] Filed: Aug. 14, 1998

[30] Foreign Application Priority Data

Aug. 15, 1997 [NL] Netherlands ..... 1006781

[51] Int. Cl.[7] ..... B65B 9/00; B65B 9/06; B65B 51/10

[52] U.S. Cl. ..... 53/450; 53/550; 53/202; 53/371.4

[58] Field of Search ..... 53/450, 459, 371.4, 53/374.4, 202, 550, 568

[56] References Cited

U.S. PATENT DOCUMENTS 3,961,697 6/1976 Hartman et al. ..... 53/550
5,337,542 8/1994 Omori ..... 53/450
5,351,464 10/1994 Francioni ..... 53/450

FOREIGN PATENT DOCUMENTS 0 725 007 8/1996 European Pat. Off. .
2 075 468 11/1981 United Kingdom .
WO 93/12974 7/1993 WIPO .

*Primary Examiner*—Brian L. Johnson
*Assistant Examiner*—Matthew Luby
*Attorney, Agent, or Firm*—Young & Thompson

[57] ABSTRACT

A packaging machine for making flow packs, which is provided with closure elements for making transverse seams in a packaging material which has been formed into a tube, and with cutting devices for then making cuts in the transverse seams. The cutting devices are arranged on the circumference of a pair of cutting rolls which, in their circumferential direction, are moreover provided with gripper elements for manipulating the flow packs.

6 Claims, 2 Drawing Sheets

PACKAGING MACHINE

FIELD OF THE INVENTION

Packaging machine for making flow packs, provided with closure means for making transverse seams in a packaging material which has been formed into a tube and cutting means for then forming cuts in the said transverse seams, the cutting means being arranged on the circumference of a pair of cutting rolls.

BACKGROUND OF THE INVENTION

In the prior art, it is known to package articles in portions in a tube which is formed from a flat web of packaging material, is closed in the longitudinal direction and is then closed in the transverse direction between articles to be packaged which have been pushed into the tube. The articles packaged in this way are also known as "flow packs".

These packaging machines are employed, inter alia, in the packaging of foodstuffs, such as chocolate bars and the like. These packaging machines can be used to reach very high production rates. For example, devices which produce more than 1500 flow packs per minute are known.

In an operating process, the machines which are to carry out further operations on the flow packs are generally unable to maintain these high production rates. In practice, this means that it is necessary to take measures in order to prevent the production process from becoming blocked up. In a solution which is regularly employed, the production rate of the packaging machine is deliberately set at a lower level than the maximum production rate which can be achieved. In another solution, in the production process the stream of flow packs is divided into two or more product streams with the aid of division means. However, even these devices which are known from the prior art for dividing a feed stream of flow packs into two or more discharge streams of flow packs are unable to maintain the high production rate of the packaging machine. The cause of this lies, inter alia, in the fact that it is necessary, for the action of the known division devices, firstly to determine the position of the flow packs before they can be manipulated. This detection step wastes time, at the expense of the processing rate of these division devices.

Therefore, production capacity of the packaging machine is left unused in both solutions.

SUMMARY OF THE INVENTION

The object of the present invention is to provide a device which is able to divide a stream of flow packs into two or more flow-pack streams without adversely affecting the production rate of the flow pack packaging machine.

This object is achieved in the present invention by the fact that gripper means are integrated in the circumferential direction of the rolls for the purpose of manipulating the flow packs.

It is advantageous in this case for not only the gripper means but also closure means to be integrated in the circumferential direction of the pair of cutting rolls.

The major advantage of this is that the gripper means can be used to divide the flow packs, at a certain distance from the central feed stream of articles to be packaged, into two or more discharge streams of flow packs as desired. This is made possible by alternately actuating the gripper means of the various closing and cutting rolls in such a manner that flow packs follow the rotational movement of the closing and cutting rolls for a period of time.

Since the means which are used for manipulating the flow packs are integrated in the cutting rolls or in the closing and cutting rolls, the successive flow packs can be manipulated at the same rate as the flow packs themselves can be produced. As a result, the production rate of the packaging machine is not limited by manipulating the flow packs.

The present invention is improved further by the fact that the gripper means comprise openings which can be connected to vacuum facilities in a controllable manner. It is advantageous in this case for suction cups to be arranged in the openings. The major advantage of using a vacuum facility is that it is possible, as a result of using a vacuum facility, to maintain the high production rates of the flow pack packaging machine.

The present invention is improved further if the openings can be connected as desired to compressed air. The advantage of this is that when the flow packs have been carried through a certain distance by the cutting and/or closing roll with the aid of a vacuum facility, the flow packs can be reliably blown onto, for example, a conveyor belt with the aid of compressed air. As a result of using compressed air, the operation of the device according to the present invention is made more reliable.

The present invention furthermore relates to a method for using the packaging machine according to the present invention. This method is characterized in that an opening on a first of a pair of cutting rolls or closing and cutting rolls is connected to a vacuum facility and then an opening of a second of the said pair of cutting rolls or closing and cutting rolls is connected to a vacuum facility.

It is in this case advantageous if two or more successive openings on a first of a pair of cutting rolls or closing and cutting rolls are connected to a vacuum facility and then two or more successive openings of a second of the pair of cutting rolls or closing and cutting rolls are connected to a vacuum facility.

The major advantage of this is that the feed stream of flow packs is divided into two or more discharge streams of flow packs, the flow packs being delivered in groups. Individual flow packs are regularly repacked together, and the method according to the present invention feeds the flow packs in groups and allows them to be repacked in groups.

BRIEF DESCRIPTION OF THE DRAWINGS

The present invention will be explained in more detail with reference to the appended drawings, in which.

DETAILED DESCRIPTION OF THE INVENTION

Figure 1:
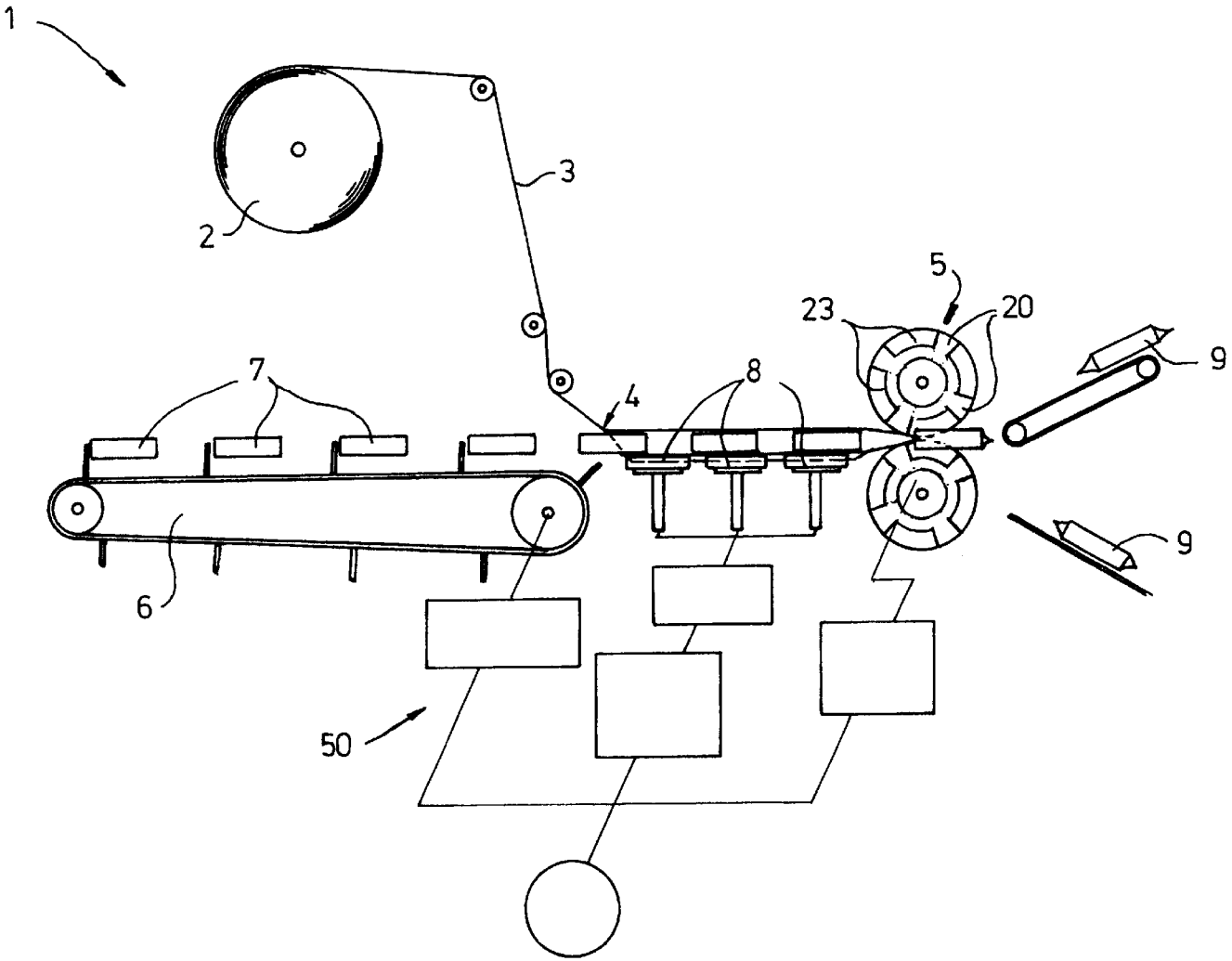
FIG. 1 shows a view of a packaging machine for making flow packs according to the present invention.

FIG. 1 shows a packaging machine 1 for making flow packs according to the present invention. In the packaging machine 1, packaging material 3 is fed from a stock reel 2, via a folding box 4, towards the closing and cutting rolls 5. With the aid of the folding box 4, the flat packaging material 3 is folded into tube form. With the aid of a conveyor belt or feed chain 6, articles or groups of articles 7 are moved, with the aid of pusher pins or projections, into the tube of packaging material 3 which has been formed in this way. The packaging material which has been folded into tube form is provided on the underside, with the aid of roller means 8, with a closure seam running in the longitudinal direction. With the aid of the closing and cutting rolls 5, transverse seams are made in the packaging material 3 between the various articles 7. While the transverse seams are being made, the successive articles are moreover cut free from one another. The seams are formed with the aid of closure blocks 20 in which cutting means are arranged (cf. FIG. 2*a*). The packaged articles 9 formed in this way are also known as flow packs. Using the closing and cutting rolls 5, the flow packs 9 are divided into one, two or more flow-pack streams as desired. The way in which this takes place is explained with reference to FIGS. 2*a*, 2*b* and 2*c*.

The various components of the packaging machine 1 are actuated and controlled with the aid of actuation and control means 50.

Figure 2C:
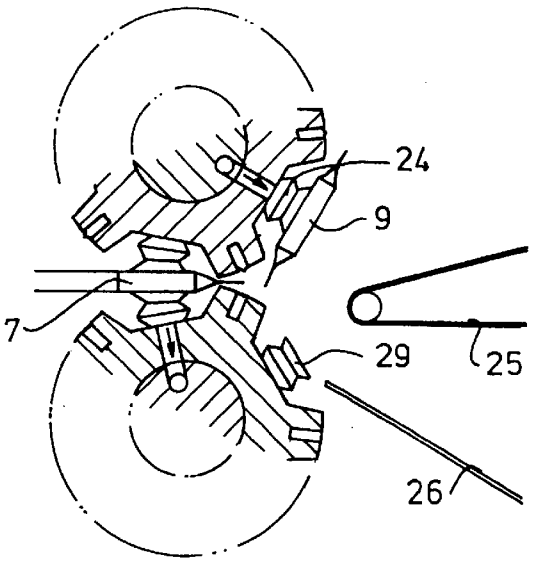
FIGS. 2*a*, 2*b* and 2*c* make it possible to see how the closing and cutting rolls according to the present invention work.
Figure 2B:
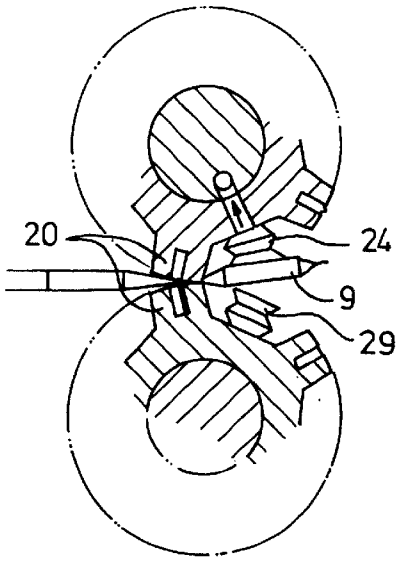
Figure 2A:
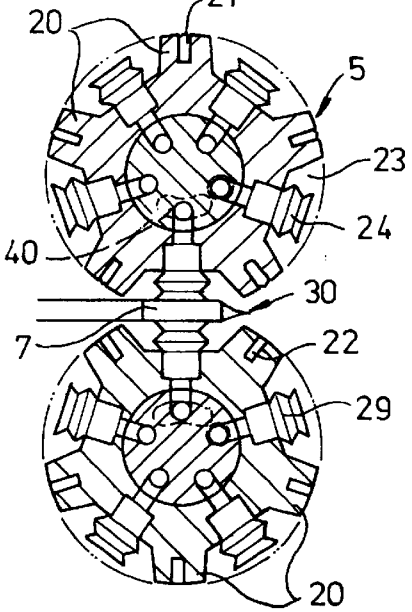

FIGS. 2*a*, 2*b* and 2*c* provide a step-by-step illustration of the action of the closing and cutting rolls 5 according to the present invention. FIG. 2*a* shows that the closing and cutting rolls are provided on their circumference with a number of closure blocks 20. These closure blocks 20 are provided in their longitudinal direction with cutting means comprising a blade 21 on one roll and an anvil 22 on the other roll. Moreover, the closing and cutting rolls 5 are provided on their circumference, between successive closure blocks 20, with openings 23 in which suction cups are situated. The suction cups on the upper closing and cutting roll 5 are denoted by reference numeral 24, while the suction cups on the lower roll 5 are denoted by reference numeral 29. These suction cups 24, 29 can be connected in a controllable manner to vacuum facilities (not shown). The suction cups 24, 29 are connected to and disconnected from the vacuum facilities with the aid of control means in a manner which is known in the prior art. If desired, the suction cups 24, 29 may also be connected to compressed air.

FIG. 2*a* shows the case where the front side 30 of a flow pack has already been provided with a transverse scam. Two suction cups 24, 29 are in contact with the article 7. By now connecting one of these suction cups, for example 24, to a vacuum facility, the suction cup 24 will be able to grip the product 7. FIG. 2*b* shows the case where the second transverse seam of the flow pack is being formed with the aid of two closure blocks 20. It can be seen in the figure that the suction cup 24 of the upper closing and cutting roll 5 is holding the article 7 in a fixed position.

It can be seen in FIG. 2*c* that the flow pack 9 formed is moved, with the aid of the upper closing and cutting roll, in a direction which does not lie in line with the feed direction of the articles 7. By, in this position, interrupting the connection between the suction cup 24 and the vacuum facility or connecting the suction cup 24 to a compressed-air line, the flow pack 9 can be blown onto the conveyor belt 25. By gripping the next flow pack 9 with the aid of a suction cup 29 of the lower closing and cutting roll 5, the next flow pack 9 can be moved in the direction of the track 26.

FIGS. 2*a* to 2*c* make it clear that, with the aid of the known closing and cutting rolls in which suction cups 24, 29 are integrated, the flow packs 9 formed can be divided into two or more flow-pack streams at a rate which is equal to the rate at which the flow packs are manufactured.

In a possible embodiment of the present invention, the welding and cutting rolls 5 are provided with passages 40 (FIG. 2*a*) which are connected to a vacuum facility or to a compressed-air facility. Owing to the presence of the passages, a number of suction cups, which are arranged in succession in the circumferential direction of the welding and cutting roll are successively actuated by the vacuum facility or compressed-air facility. By then adapting the position in which the passages 40 are connected to the vacuum facility and compressed air in the two interacting welding and cutting rolls 5 in relation to one another, firstly a number of flow packs 9 from a stream of flow packs is sucked onto the suction cups 24 of one welding and cutting roll 5, and then a number of flow packs 9 is sucked onto the suction cups 29 of the second welding and cutting roll 5, with the particular feature that this takes place without the need for special control means to be provided for this purpose. The major advantage of this is that the feed stream of flow packs is divided in groups into discharge streams. Since, in numerous production processes, a number of flow packs are packaged once again, it is possible in this way to carry out a preparatory step for the further packaging of a group of flow packs.

Using a pair of welding and cutting rolls 5 each with, for example, ten closing and cutting blocks and ten suction cups 24, 29, it is possible, by this measure, to divide a stream of flow packs into two streams which are each supplied with flow packs in groups of five items.

What is claimed is:

1. A packaging machine for making flow packs, provided with a cut and seal unit for making transverse seams in a packaging material which has been formed into a tube and for forming cuts in the transverse seams, the cut and seal unit comprising a first and second roller, rotating respectively about a first and second axis; the first and second roller providing therebetween a path for the packaging material; at least a first and a second cut and seal head being fitted respectively to the first and second roller; the first and second cut and seal heads cooperating cyclically with each other at a portion of said path extending between the rollers; and wherein each of the first and second rollers is provided with a gripper means; the gripper means being fitted to the roller between adjacent cut and seal heads; and said gripper means comprising openings for connecting the gripper means to vacuum facilities.

2. The packaging machine according to claim 1, further comprising suction cups arranged in the openings.

3. The packaging machine according to claim 1, wherein the openings are structured and arranged to be connected to a source of compressed air.

4. In a method for making flow packs, which comprises forming a packaging material into a tube, making transverse seams in the packaging material, and then forming cuts in the transverse seams, the improvement which comprises manipulating a flow pack with gripper means positioned downstream from means for making a cut in the transverse seams; the flow pack being manipulated by the gripper means before the cut in the transverse seams is completed, the gripper means being fitted on each of a first and second cut and seal roller, and being connected to a vacuum facility.

5. The method for making flow packs according to claim 4, wherein the gripper means on a first of a pair of cut and seal rollers are connected to the vacuum facility, and thereafter the gripper means of a second of the pair of cut and seal rollers are connected to the vacuum facility, such that the vacuum facility is alternately connected to the gripper means on the first of the pair of cut and seal rollers, and subsequently to the second of the pair of cut and seal rollers.

6. The method according to claim 4, wherein successive gripper means on a first of a pair of cut and seal rollers are connected to a vacuum facility, and thereafter successive gripper means of a second of said pair of cut and seal rollers are connected to the vacuum facility.

* * * * *